US006401416B1

(12) United States Patent
Ytterberg

(10) Patent No.: US 6,401,416 B1
(45) Date of Patent: Jun. 11, 2002

(54) VEE JOINT FOR USE IN FILLING SHRINKAGE COMPENSATING CONCRETE FLOOR JOINTS

(75) Inventor: Carl N. Ytterberg, Evergreen, CO (US)

(73) Assignee: Kalman Floor Company, Evergreen, CO (US)

( * ) Notice: Subject to any disclaimer, the term of this patent is extended or adjusted under 35 U.S.C. 154(b) by 0 days.

(21) Appl. No.: 09/832,829

(22) Filed: Apr. 12, 2001

(51) Int. Cl.[7] ..... E04B 1/68

(52) U.S. Cl. ..... 52/396.04; 52/396.02; 52/573.1; 52/742.1

(58) Field of Search ..... 52/396.02, 396.04, 52/573.1, 742.1; 404/47, 49

(56) References Cited

U.S. PATENT DOCUMENTS 1,891,530 A * 12/1932 Galassi ..... 404/47
2,198,084 A 4/1940 Jacobson
3,124,047 A * 3/1964 Graham ..... 404/47
3,593,626 A * 7/1971 Crone ..... 404/49
3,604,169 A * 9/1971 Smith ..... 52/396.04
D236,715 S * 9/1975 Patterson ..... 52/396.04 X
D236,716 S * 9/1975 Patterson ..... 52/396.04 X
4,128,358 A * 12/1978 Compton ..... 404/47
4,423,979 A * 1/1984 Brown ..... 404/47 X
5,282,693 A * 2/1994 Daily, Jr. ..... 404/47

* cited by examiner

*Primary Examiner*—Beth A. Stephan
*Assistant Examiner*—Brian E. Glessner
(74) *Attorney, Agent, or Firm*—Dykema Gossett PLLC

(57) ABSTRACT

A vee joint having a first flange hingedly connected to a second flange at an angle. A trough is formed between the first flange and the second flange and is used to retain joint filler within a joint interval in a concrete floor slab. The flanges are movable to facilitate the placement and retention of the vee joint within various sized joints in concrete slab flooring. When the vee joint is placed within a joint interval, the flanges may be spaced varying distances apart to accommodate joint filler therebetween and to intimately engage with the confronting walls of the floor slab to avoid bypass of joint fill material.

15 Claims, 1 Drawing Sheet

VEE JOINT FOR USE IN FILLING SHRINKAGE COMPENSATING CONCRETE FLOOR JOINTS

BACKGROUND OF THE INVENTION

Concrete floors are typically composed of a plurality of rectangular slab panels placed on separate days and joined together by slip dowels (for load transfer) or tie rods (reinforcing bar—usually for resistance to earthquakes—or to increase the moment capacity of walls and foundations) or merely abutted to one another as the daily progression of slab panel placements ensures. The joints resultant from adjacent placements of smaller concrete slab panels are known as "bulkhead construction joints" (or "bulkhead joints", or simply as "construction joints"), and should not be confused with sawn or tooled joints within each individual concrete floor slab placement that are used primarily for the organization and control of concrete cracking—such joints are commonly known as "control joints" or "contraction joints". (Nor should they be confused with isolation joints which occur between slab panels and other building elements.) In essence, construction joints occur at the perimeter of every concrete slab panel (4 sides) that abuts another concrete slab panel.

Subsequently to slab placement, long after the concrete has hardened, the construction joints are filled with commonly known semi-rigid joint filler materials intended to close the gap between the slabs for the purposes of housekeeping and to provide a means of load transfer from the top edge of one concrete panel to another, thereby minimizing the possibility of edge break down under repeated traffic, esp. heavily loaded, small wheeled traffic commonly found in forklift environments.

The major problem with joint filler at construction joints is that it is not economical to fill the joint from the ground, up to the top of the slab and to do so would adhere the separate slab panels together, increasing the likelihood of undesirable cracking. Thus, construction joints are typically filled first with some backer material like sand or foam "backer-rod", so the residual depth to fill with semi-rigid joint filler material is a fraction of the depth of the concrete slab itself. The consequences of this industry-wide approach may be summarized as follows:

1. Sand-like fillers tend to subside beneath the semi-rigid joint filler because the adjacent slab panels shrink away from each other, and slab panel edges tend to curl upward, providing a void for the sandy material to subside into.

2. Foam "backer-rod" materials provide no support beneath a joint filler subject to concentrated wheel loads.

3. The semi-rigid joint fillers harden to the width of the construction joint at the time of filling and are too rigid to accommodate thermal and drying shrinkage movement of the adjacent slab panels, losing adhesion with one panel or the other, or splitting itself, so that load transfer from panel edge to panel edge is lost. Also, and especially for shrinkage compensating concrete (SCC) floor slabs, the construction joint movement is so large relative to the original joint width, repeated impact from concentrated loads forces the joint filler materials downward into the joint, or results in a rebound of the filler so that it emerges from the joint.

As mentioned, SCC floor slabs typically have much wider joints than their counterpart slabs composed of traditional portland cement/pozzolanic materials, because SCC slab panels are subject to thermal and drying shrinkage movement as are their counterparts, but SCC slabs have no interior contraction joints at which to relieve the drying shrinkage and thermal movement, hence all the movement occurs at the construction joints. For instance, a traditional portland cement/pozzolanic concrete slab panel about 100' by 100' would usually have a control joint every 15'—two ways, or roughly 5 interior joints in each direction where the drying shrinkage and thermal movement may be approximately 0.01" per joint, for instance. In contrast, a shrinkage compensating slab panel of equal size has no interior joints. So, in this example, the added movement at a shrinkage compensating construction joint would approximate 5×0.01"=0.05" divided by 2 (one construction joint at the two opposing edges of each panel) or 0.025" more than the construction joint of a typical slab. Therefore, it is more common for the joint filler in construction joints of a shrinkage compensating slab to come loose and become ineffective, requiring repeated expensive and wasteful refilling of the joint.

SUMMARY OF THE INVENTION

It is an object of the present invention to provide an economical and easy to install support mechanism for the joint filler in concrete slabs, hereafter referenced as a vee joint. The objective of this invention is accomplished by a vee joint having a first flange connected to a hinge and a second flange connected to the same hinge at an angle A from the first flange. The hinge may be a separately constructed device, but it is intended to typically be that point where a material is folded over upon itself. A trough is formed between the first flange, the second flange, and the hinge which is used to retain joint filler within a shrinkage compensating concrete floor slab construction joint. The flanges can be adjusted so the angle therebetween is increased or decreased to fit within various sized construction joints and to accommodate the movement of the floor joints as they become wider and narrower. The flange width may be enlarged or decreased to fit various joint depths. Additionally, the support provided by the rigid nature of the hinge minimizes the process wherein joint filler is forced downward into a joint by concentrated loads traversing it. Adhesion of the joint filler when in contact with the flanges minimizes joint filler from emerging from the joint.

The Vee joint of the present invention is primarily a V-shaped set of flanges joined by a hinge. The Vee joint is configured to be narrower at its base than the distance between its upper flanges, hence creating a "V" or "U" shaped cross-section. The vee joint is adapted to fit various size joints and it is used to retain the joint filler within a joint and prevent it from being pushed further into the joint or from being forced out of the joint due to impact.

The vee joint herein described can be used in floor joints that either have or do not have edge armor (embedded steel at the slab panel edge). In fact, the vee joint could be used in most any type of floor slab joint. The vee joint can be installed above load transfer devices (dowels) and rest upon them, providing more substantial support of the joint filler above. Where no load transfer device exists, the vee joint can be forced into a joint, the friction between its flanges and the concrete slab panels providing support for the joint filler, or it may be simply forced down into the joint to the base below the slab, where it will minimize the escape of preliminary sand-like fillers, increasing the longevity of the semi-rigid joint filler above them.

Other objects, advantages and novel features of the invention will become apparent from the following detailed description of the invention when taken in conjunction with the accompanying drawings.

DETAILED DESCRIPTION OF THE INVENTION

Figure 1:
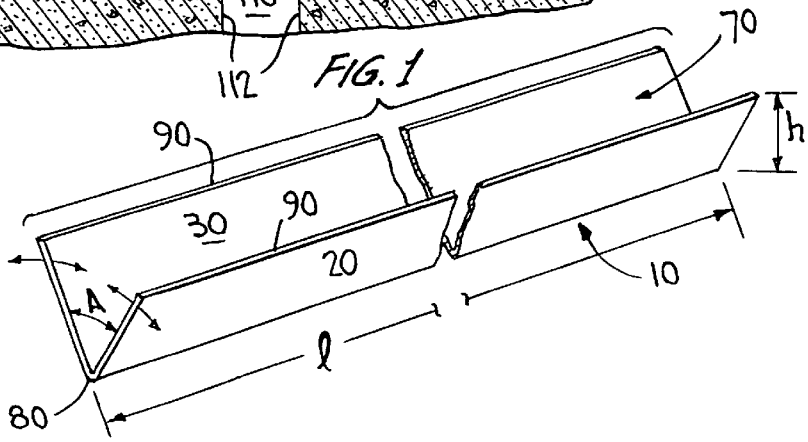
FIG. 1 is a partial perspective view of the first embodiment of the vee joint showing the present invention in detail.

FIG. 1 shows the preferred embodiment of the vee joint, generally designated 10, wherein the flanges 20,30 are hingedly connected to one another with hinge 80 so as to form a channel or trough 70 therebetween. Flange 20 is connected at an angle A to flange 30 and either flange can be rotated about the hinge 80 to either increase or decrease the angle A and thereby adjust the spacing between upper edges 90.

Figure 5:
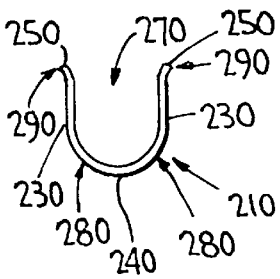
FIG. 5 is an end view of a second embodiment of the vee joint of the present invention.

Upper edges 90 of the flanges 20,30 may rest upon the entire lengthwise extent of joint walls 112 (FIG. 3) when the vee joint 10 (having a length l which is substantially the same as that entire lengthwise extent) is in use within a joint interval 110 and may have a lip 250 as is further discussed with regard to FIG. 5.

The first embodiment of the vee joint 10 may be formed from a single piece of inorganic material that is folded in the central portion thereof forming the two flanges 20,30 and angle A.

Figure 2:
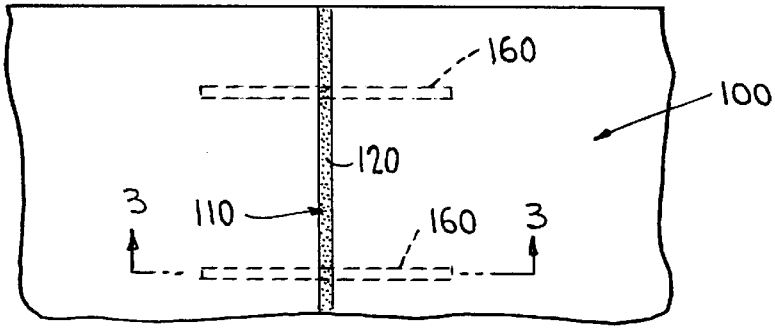
FIG. 2 is a partial top plan view of a construction joint in a concrete floor which includes but does not show the vee joint of the present invention.
Figure 3:
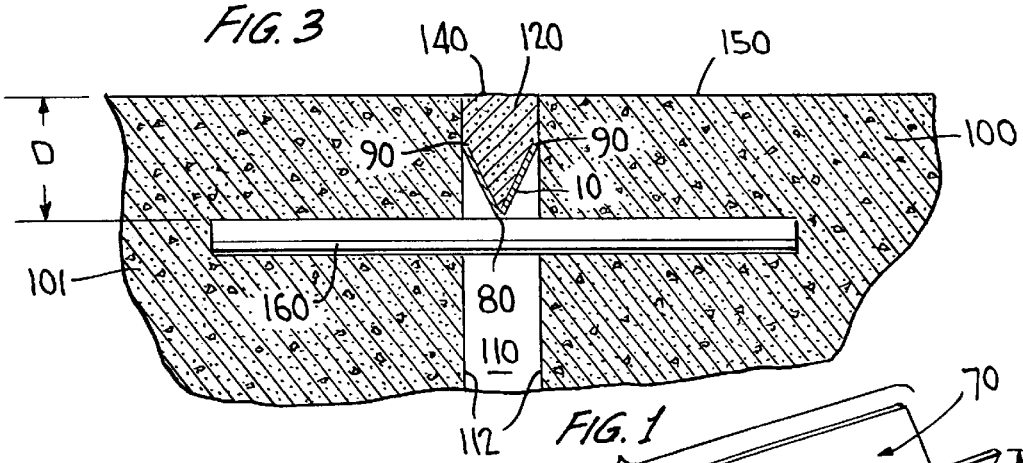
FIG. 3 is a view of the vee joint of the present invention shown in a construction joint of a concrete floor, and taken substantially along line 3—3 of FIG. 2.

As shown in FIGS. 2 and 3, when the vee joint 10 is in use, it is placed within a joint interval 110 of a concrete floor or slab 100 and 101 where it rests upon a load transfer element or elements 160, such as a dowel or dowels. The load transfer elements 160 may be intermittently placed throughout the floor structure to provide support to the vee joints 10. The vee joint 10 can also be placed upon any type of slab support such as insulation, sub-grade supports, slip sheets or the like.

The flanges 20,30 (FIG. 1) are movable toward and away from one another, and can easily be set to a specific width to accommodate various sized joints between concrete slab 100 and 101. Therefore, the wider the joint interval 110, the wider the span of the vee joint 10 must be. They may also be enlarged or decreased in dimension "h" to fit into varying joint depths "d".

The vee joint 10 is used to support joint fill material 120 within the joint interval 110. Enough joint fill material 120 is maintained within the joint 10 so that the top of the joint fill material is the same height as the top surface 150 of the floor slabs 100, thereby creating a constant floor surface throughout the entire floor. By maintaining a constant floor surface, erosion to the corners and edges of the floor slabs 100, caused by heavy equipment, is minimized.

Due to the movable nature of the flanges 20,30, when a large angle A is formed between the flanges 20,30, the span that the flanges 20,30 will fill is greater. When a narrow joint interval 110 exists, the angle A between the flanges 20,30 can be reduced, thus bringing the ends 90 of the flanges 20,30 closer together to fill the narrower joint interval 110. This flexible configuration of the vee joint 10 allows the installation of the vee joint 10 to be easy and expedient regardless of the size and shape of the joint interval 110. For example, a vee joint 10 can be forced into an opening wider than its base or hinge 80 but narrower than the edges 90 of the flanges 20,30 when they are placed in their support position, and then the vee joint 10 is configured to fit within the joint interval 110 by spreading the flanges 20,30 out to their support or extended position.

The flexible nature of the vee joint 10 also allows for a single size vee joint 10 to be manufactured so as to accommodate various types and sizes of joint intervals 110, making the manufacture economical and easy. The vee joint 10 can change along with the joint 110 if the joint 110 expands or contracts during use of the floor.

The vee joint 10 is designed to retain joint filler 120 above the vee joint 10 at a level even with the top surface 150 of the floor slab 100 as shown in FIG. 3.

The configuration of the vee joint 10 behaves in a cup-like fashion catching the joint filler 120 between the flanges 20,30 and retaining it therein. When liquid filler is installed the flanges 20 and 30 minimize its passage beyond vee joint 10 until it hardens. When forces are applied to the top edge 140 of the joint filler 120, the flanges 20,30 are forced outwardly, distributing the load against the slabs 100 and 101 and as well as onto load transfer for elements 160.

FIG. 3 shows the hinge 80 of the vee joint 10 resting on load transfer elements 160 (FIG. 2) for support within a floor slab 100. When in use, the upper edge 90 of each flange 20, 30 rests against a joint wall 112, one on each side of the joint interval 110.

With the hinge 80 and each upper edge 90 of each flange 20, 30 supported, the joint filler 120 is prevented from moving past the vee joint 10 and being forced further within the joint interval 110. The top edge 140 of the joint filler 120 is also maintained level with the top surface 150 of the floor slab.

Figure 4:
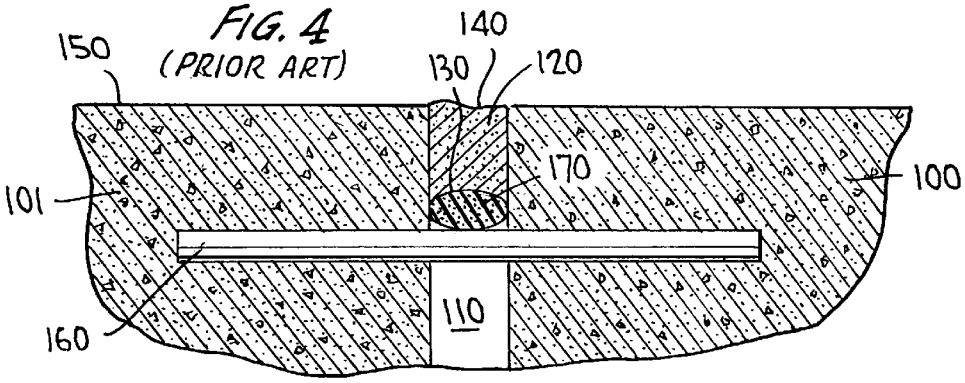
FIG. 4 (PRIOR ART)
FIG. 4 is a view similar to FIG. 3 of a backer rod according to the prior art shown in a construction joint of a concrete floor.

As shown in FIG. 4, it is a common practice to fill the joint interval 110 with a backer element 170 that is typically a foam (as shown) rod which is round or oval in shape, for the purpose of minimizing passage of liquid joint filler beyond it. Sand or grit fill may be used in place of the backer rod 170. The rod 170 is not a very effective way to retain the hardened joint filler 120 within the joint interval 110 and above the load transfer device 160 because it provides little, if any, support.

When a force is applied to the top edge 140 of the joint filler 120, which is common when heavy objects such as forklifts and other vehicles drive across the top surface 150 of the floor 100, the joint filler 120 is forced in a downward direction within the joint interval 110. Eventually, enough of the joint filler 120 is pushed deep within the joint interval 110 resulting in an open space within the joint interval at or just below the surface level 150 of the floor 100.

FIG. 5 shows a cross-sectional view of a second embodiment of the vee joint 210 described herein. In this second embodiment, the vee joint 210 has two flanges 220, 230, one on each side of the vee joint 210. Each flange 220, 230 has a connected end 280 and a free end 290. The connected end 280 of each respective flange 220, 230 connects the flange 220, 230 to a central, cross member 240 forming a U-shaped vee joint 210.

The cross member 240 can be straight or curved in shape. The connected end 280 of each flange 220, 230 is flexible so as to allow each flange 220, 230 the ability to move in a hinged manner with respect to the cross member 240. Therefore, the flanges 220, 230 of the second embodiment of the vee joint 210 are movable allowing the vee joint 210 to be adaptable to fit into various sizes and shapes of joint intervals 110.

The free end 290 of each flange 220, 230 may be flared or slightly angled from the respective flange 220, 230 forming a lip 250 thereon. The lip 250 rests against the joint walls 112 and prevents the joint filler 120 from being forced past the vee joint 210 into the joint interval 110. Each lip 250 may even be driven into the joint walls 112 by the pressure of the joint fill material 120.

Although particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims. For example, the hinge 80 may be made of varying widths to accommodate various sized joint intervals 110 and support greater amounts of joint filler 120 therein.

The vee joint 10 may be made of a single piece of material wherein the flanges and hinge are all integrally formed with one another, or the vee joint may be comprised of separate and distinct elements that have been connected together through conventional connection means.

What is claimed is:

1. A method of supporting joint filler within a joint interval in a concrete slab floor structure, said method comprising the steps of:

providing an elongated vee joint having a first flange hingedly connected to a second flange forming a hollow channel therebetween, said channel having a hinged end and an open end of a predetermined width defined by a predetermined spacing between upper edges of the flanges;

placing said vee joint within the joint interval of the floor structure;

solely supporting the vee joint within the joint interval at the hinged end;

arranging said vee joint into a position within said joint where said hinged end of said channel is lower than said open end of said channel, and said open end of said channel being spaced a predetermined distance below a top surface of said floor structure to define a fill portion;

setting the predetermined spacing of said flanges into engagement with opposing side walls defining the joint interval;

filling said channel and said fill portion of the joint interval located above said vee joint with joint filler;

whereby the joint filler is supported within the joint interval thereof.

2. The method according to claim 1, wherein the vee joint rests upon load transfer devices when placed within the joint interval.

3. A vee joint for retaining joint filler within a joint interval in a concrete slab floor, comprising:

a channel for retaining joint filler therein;

said channel having at least two flanges and at least one hinged connection therebetween;

each of said flanges having a free end opposite said at least one connection, and a connected end at said at least one connection at which the vee joint is wholly supported within the joint interval;

said flanges being movable about said at least one connection and capable of being spaced varying distances from one another to accommodate joint filler therebetween and to engage, without interlock, opposing walls defining the joint interval;

said free ends of said flanges being spaced apart a distance wider than said connection and facing toward the top surface of the floor, wherein, when in use, said vee joint is positioned between slabs in a concrete slab floor at a depth to define a fill portion between said free ends of said flanges and the top surface of the floor so as to retain joint filler at the fill portion and in an area bounded by said free edges of said flanges and said connection thereby causing the joint to be filled so as to maintain a consistent floor surface between the slabs.

4. The vee joint of claim 3, wherein:

said channel is of unitary construction.

5. The vee joint of claim 4, wherein:

said flanges are connected at an angle from one another;

said channel has a V-shaped cross-section with the angle between said flanges being variable.

6. The vee joint of claim 4, wherein:

said channel further comprises a cross member between said flanges;

said flanges being hingedly connected at an angle to said cross member and forming a U-shaped cross-section, with the angle between each said flange and said cross member being variable.

7. A vee joint for retaining joint filler within opposing walls of a joint interval in a concrete slab floor, comprising:

a first flange connected to a second flange with a live hinge therebetween forming an angle;

free edges of the flanges facing toward a top surface of the floor, and the vee joint being solely supported within the joint interval at the live hinge;

said first flange and said second flange engaging, without interlock, the walls of the joint interval at the adjacent slabs in the concrete floor;

said flanges being movable toward and away from one another about the live hinge to be set to a specific width to accommodate various sized joint intervals;

said edges of the flanges being spaced from the top surface of the floor to define a fill portion;

the vee joint supporting joint filler in the fill portion and in a channel defined by said first flange, said second flange and said live hinge.

8. The vee joint of claim 7, wherein:

said flanges and said hinge are integrally formed with one another.

9. The vee joint of claim 8, wherein:

said channel has a V-shaped cross-section with said angle being variable.

10. The vee joint of claim 8, wherein:

said vee joint is made of inorganic material.

11. A vee joint for retaining joint filler within opposing walls of a joint interval in a concrete slab floor, comprising:

a first flange hingedly connected at a first angle to a first end of a cross member;

a second flange hingedly connected at a second angle to a second end of said cross member;

free edges of the flange facing toward a top surface of the floor, and the vee joint being solely supported within the joint interval at a live hinge defined by the hinged connections of the first and second flanges;

said first flange and said second flange engaging, without interlock, the walls of adjacent slabs in the concrete floor;

said flanges movable toward and away from one another about the cross member to be set to a specific width to accommodate various sized joint intervals;

the vee joint supporting joint filler in the fill portion and in a channel defined by said first flange, said second flange and said cross member.

12. The vee joint of claim 11, wherein:

said flanges and said cross member are integrally formed with one another.

13. The vee joint of claim 12, wherein:

said channel has a U-shaped cross section with said angles being variable.

14. The vee joint of claim 13, wherein:

each said flange has a lip thereon for engaging the walls of the joint.

15. The vee joint of claim 14, wherein:

said vee joint is made of inorganic material.

* * * * *